US007849847B2

(12) United States Patent
Cheng et al.

(10) Patent No.: US 7,849,847 B2
(45) Date of Patent: Dec. 14, 2010

(54) DRAINAGE APPARATUS FOR A SINGULATION SYSTEM

(75) Inventors: Chi Wah Cheng, Hong Kong (HK); Lap Kei Eric Chow, Hong Kong (HK); Chi Hang Leung, Hong Kong (HK)

(73) Assignee: ASM Assembly Automation Ltd, Hong Kong (HK)

( * ) Notice: Subject to any disclaimer, the term of this patent is extended or adjusted under 35 U.S.C. 154(b) by 655 days.

(21) Appl. No.: 11/853,326

(22) Filed: Sep. 11, 2007

(65) Prior Publication Data

US 2009/0064834 A1 Mar. 12, 2009

(51) Int. Cl.
*B28D 1/02* (2006.01)

(52) U.S. Cl. ..... 125/12; 83/168; 83/401; 125/13.01

(58) Field of Classification Search ..... 83/100, 83/165, 168, 401; 125/13.01, 16.01, 16.02, 125/14, 12
See application file for complete search history.

(56) References Cited

U.S. PATENT DOCUMENTS 3,824,890 A * 7/1974 Zettler et al. ..... 409/134
5,329,733 A * 7/1994 Steere, Jr. ..... 451/10
5,647,788 A * 7/1997 McHugh et al. ..... 451/21
6,354,285 B1 3/2002 Licht et al. ..... 125/13.01
6,500,058 B2 12/2002 Bajo et al. ..... 451/361
6,733,377 B2 * 5/2004 Adachi et al. ..... 451/455
6,780,091 B2 * 8/2004 Mizomoto et al. ..... 451/67
6,949,015 B2 * 9/2005 Kubota ..... 451/178
2004/0014408 A1 * 1/2004 Sekiya ..... 451/342

* cited by examiner

*Primary Examiner*—Timothy V Eley
(74) *Attorney, Agent, or Firm*—Ostrolenk Faber LLP

(57) ABSTRACT

A singulation system for a workpiece has a carrier for mounting the workpiece during singulation and a receptacle for collecting debris formed. A driving mechanism, which is operative to move the carrier and the workpiece, is at least partially covered by a bellows. A bellows protecting cover extending over the bellows is coupled between the carrier and the receptacle and is operative to guide debris from the carrier along its longitudinal length towards the receptacle. The bellows protecting cover further comprises side walls extending along opposite sides of its longitudinal length to prevent debris from falling off its sides.

19 Claims, 5 Drawing Sheets

DRAINAGE APPARATUS FOR A SINGULATION SYSTEM

FIELD OF THE INVENTION

The present invention relates to a singulation system for singulating electronic components, and in particular to the removal of debris from the singulation system during singulation.

BACKGROUND AND PRIOR ART

A singulation system for singulation or dicing electronic components, such as semiconductor substrates or packaged semiconductor devices, comprises at least a spindle system and a carrier support such as a chuck table. The cutting axis of the spindle system is orthogonal to the motion axis of the chuck table and a theta axis table is located on top of the chuck table. The spindle system typically includes either one or two high speed rotating shafts with a sawing blade each.

Dicing may be performed on the semiconductor substrate by moving the chuck table under a spindle axis while the sawing blade is cutting the semiconductor substrate on a carrier, such as a saw jig, on the chuck table. Cooling water is sprayed onto the sawing blade and the substrate during dicing. Chips, scrap and other debris are also formed during the process.

The chuck table is mounted on and guided by a slide while it is driven along its motion axis. In order to protect the slide and the motorized chuck table driver from the used machining water and from scrap and debris from the sawing process, bellows are provided that extend over and cover the slide on which the chuck table is driven. However, the bellows may not provide sufficient protection for the slide and the chuck table driver as explained below.

During the dicing process, scrap, debris and singulated substrates with very sharp edges may fly off the electronic components being cut, and drop between the folds of the bellows. This may cause the bellows to be cut and damaged. Water and debris may then drop through the cut bellows and damage the slide and chuck table driver. An expandable cover is thus preferably placed over the bellows as a shield from these sharp objects. The bellows protecting cover channels used machining water, scrap and debris along its longitudinal length to a receptacle positioned at an end of the cover. However, some of the debris may flow along the horizontal sides of the cover and drop off the sides of the cover. A drainage channel may further be located at each side of the bellows to collect such debris, which may subsequently be removed manually or directed to flow away with the water in the drainage channel. A problem is that, over a period of time, some of this debris accumulates and clogs the drainage channels. It is therefore necessary to intermittently halt the dicing machine in order to remove the accumulated debris.

U.S. Pat. No. 6,354,285 entitled "Attachment for a Dicing Saw" discloses an example of a collector for automatically collecting debris falling off the horizontal length of a bellows protecting cover during operation of a dicing saw. The collector includes drainage channels with sloping floors, each sloping downwards towards a debris container. Scrap and debris falling off from the horizontal sides of the bellows protecting cover collect in the drainage channels. A pressure means, such as a water jet or an air jet, is installed at the upper end of the sloping floor to provide a pressurized fluid to wash fallen debris down the sloping floor. While debris is automatically removed without the need to stop the dicing machine, this arrangement requires additional drainage channels and a pressure means to cause the debris to move into the debris container. It is desirable to devise a simpler drainage apparatus to collect and remove debris by eliminating these extra requirements.

Another prior art U.S. Pat. No. 6,500,058 entitled "Clogging-Free Drain System Installed in a Cutting Apparatus" discloses a water case for receiving used machining water and a drain pool for temporarily storing the used machining water from the water case before draining off this water. However, it would be more advantageous to be able to immediately channel the used water away from the system instead of having to provide a drain pool to store the water for a period of time.

SUMMARY OF THE INVENTION

It is thus an object of this invention to seek to provide a drainage apparatus which efficiently collects and removes debris and water resulting from singulating electronic components which avoids some of the disadvantages of the aforesaid prior art.

According to a first aspect of the invention, there is provided a singulation system for a workpiece, comprising: a carrier for mounting the workpiece during singulation; a receptacle operative to collect debris formed during singulation; a driving mechanism for moving the carrier and workpiece; a bellows that at least partially covers the driving mechanism; and a bellows protecting cover extending over the bellows which is coupled between the carrier and the receptacle and which is operative to guide debris from the carrier along a longitudinal length of the bellows protecting cover towards the receptacle; wherein the bellows protecting cover comprises side walls extending along opposite sides of the longitudinal length of the bellows protecting cover which prevent debris from falling off the sides of the bellows protecting cover.

According to a second aspect of the invention, there is provided a drainage apparatus for a singulation system for a workpiece mounted on a carrier during singulation, the singulation system further comprising a driving mechanism for moving the carrier and workpiece and a bellows that at least partially covers the driving mechanism, the drainage apparatus comprising: a receptacle operative to collect debris formed during singulation; and a bellows protecting cover extending over the bellows which is coupled between the carrier and the receptacle and which is operative to guide debris from the carrier along a longitudinal length of the bellows protecting cover towards the receptacle; wherein the bellows protecting cover comprises side walls extending along opposite sides of the longitudinal length of the bellows protecting cover which prevent debris from falling off the sides of the bellows protecting cover.

It would be convenient hereinafter to describe the invention in greater detail by reference to the accompanying drawings which illustrate one embodiment of the invention. The particularity of the drawings and the related description is not to be understood as superseding the generality of the broad identification of the invention as defined by the claims.

BRIEF DESCRIPTION OF THE DRAWINGS

The present invention will be readily appreciated by reference to the detailed description of a preferred embodiment of the invention when considered with the accompanying drawings, in which.

DETAILED DESCRIPTION OF THE PREFERRED EMBODIMENT OF THE INVENTION

The preferred embodiment of the present invention will be described hereinafter with reference to the accompanying drawings.

Figure 1:
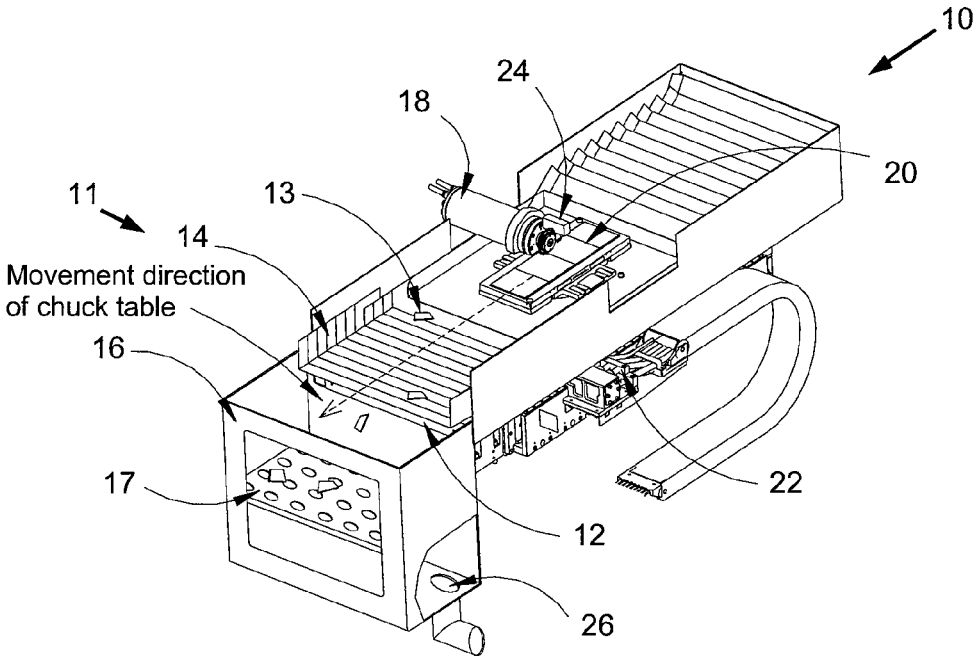
FIG. 1 is an isometric view of a singulation system equipped with a drainage apparatus in accordance with the preferred embodiment of the invention for collecting and removing debris.

FIG. 1 is an isometric view of a singulation system 10 equipped with a drainage apparatus 11 in accordance with the preferred embodiment of the invention for collecting and removing debris 13. The singulation system 10 includes a carrier which may include a chuck table 20 for mounting a workpiece which is positioned below a spindle 18 for dicing. A driving mechanism 22 which includes a slide is operative to drive the chuck table 20 together with the workpiece to move. The driving mechanism 22 is at least partially covered by a bellows 12. The bellows 12 is in turn shielded from debris 13 by a bellows protecting cover 14 extending over the bellows 12 which is coupled between the chuck table 20 and the receptacle 16, which opens to the receptacle 16 at one end. The bellows protecting cover 14 guides debris from the chuck table 20 along a longitudinal length of the bellows protecting cover 14 towards the receptacle 16. The driving mechanism 22 moves the chuck table 20 along the longitudinal length of the bellows protecting cover 14.

The bellows protecting cover 14 is preferably coupled to the bellows 12. As a result, when the bellows 12 retracts and extends over the driving means and the slide 22, the bellows protecting cover 14 retracts and extends correspondingly in the directions of movement of the bellows 12. The bellows protecting cover 14 further comprises side walls extending along opposite sides of the bellows protecting cover 14. The cover 14 therefore forms a channel that has two substantially vertical side walls on either side to prevent scrap and debris produced from the singulating process from falling off the sides of the cover 14. The side walls are preferably substantially parallel to a linear axis along which the chuck table 20 is driven by the driving mechanism 22. The bellows protecting cover 14 guides all debris and water directly towards the receptacle 16 at the end which has a filter 17 to allow used machining water to drain away. It is therefore not necessary to install any drainage channels for collecting and removing debris that may fall from the sides of the bellows protecting cover 14.

Figure 2:
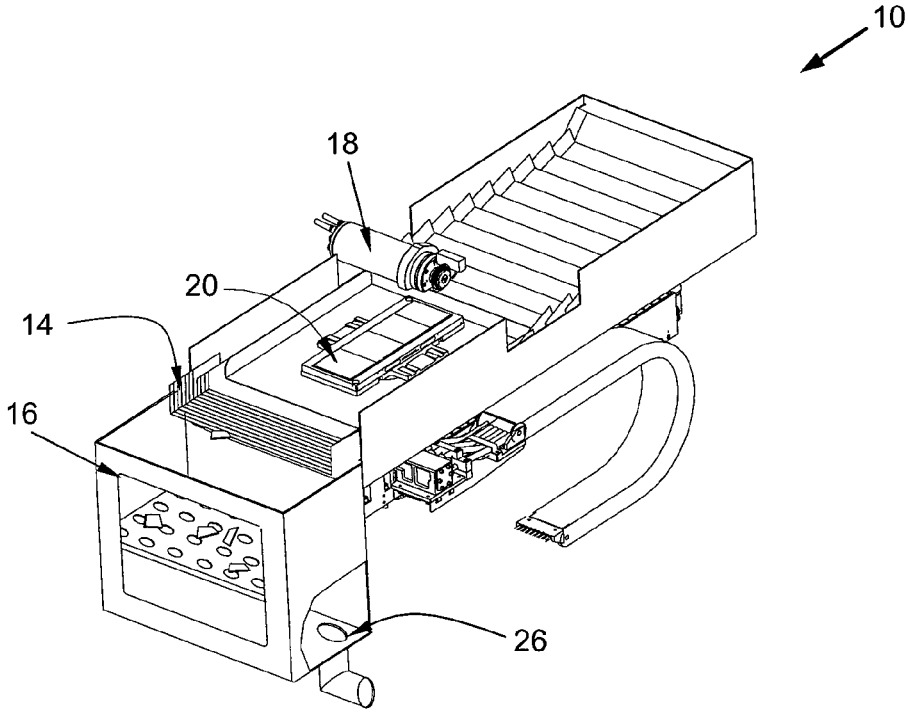
FIG. 2 is an isometric view of the singulation system of FIG. 1 showing the chuck table when it is moved nearer to a receptacle for collecting debris.

FIG. 2 is an isometric view of the singulation system 10 of FIG. 1 showing the chuck table 20 when it is moved nearer to a receptacle 16 for collecting debris. After singulation, the workpiece on the chuck table 20 is transported away from the spindle 18 towards the receptacle 16. Debris and used machining water from the singulation process are carried along with the chuck table 20, and as the carrier including the chuck table 20 abuts the bellows protecting cover 14, it will push debris to drop into the receptacle 16 by gravity at the end of the bellows protecting cover 14 as it moves towards the receptacle 16. Used machining water flows through the filter 17 of the receptacle 16 and is carried away by the drain hole 26 while debris is retained in the receptacle 16.

Figure 3:
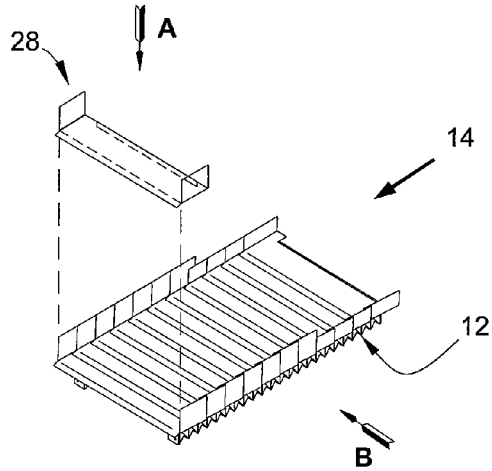
FIG. 3 is an isometric view of a bellows protecting cover for use with the drainage apparatus of FIG. 1.

FIG. 3 is an isometric view of a bellows protecting cover 14 for use with the drainage apparatus 11 of FIG. 1. The bellows protecting cover 14 is coupled to the bellows 12 and expands and retracts according to the movement of the bellows 12. Details of the panels 28 from directions A and B are respectively illustrated in FIGS. 4, 5 and 6. The bellows protecting cover 14 is expandable and contractible in the direction of motion of the chuck table 20, and preferably comprises a plurality of U-shaped panels 28 arranged lengthwise next to one another. All the panels 28 are preferably of substantially equivalent dimensions for ease of manufacturing and their two narrower ends are folded vertically upwards to form U-shapes. The folded panels 28 are joined together so as to prevent water and debris from falling over the sides of the bellows protecting cover 14 as well as seeping into the gaps between the panels 28 when the chuck table 20 moves towards the receptacle 16.

Figure 4:
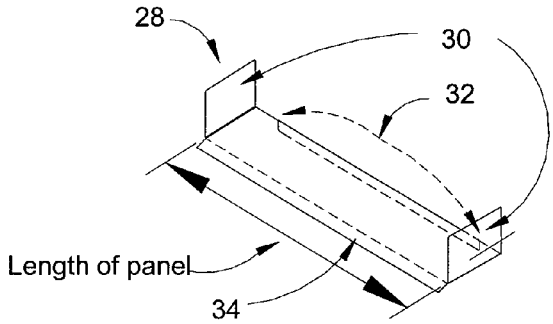
FIG. 4 is an isometric view of a panel of the bellows protecting cover as seen from direction "A" of FIG. 3.

FIG. 4 is an isometric view of a panel 28 of the bellows protecting cover 14 as seen from direction "A" of FIG. 3. The vertically folded ends 30 of the panel 28 prevent debris and water from flowing horizontally outwards from the sides of the bellows protecting cover 14. Part of the length of the panel 28 nearest to the chuck table 20 is folded downwards to form a fold 32 for attaching it to the surface of the bellows 12. The length of the opposite side of the panel 28 facing away from the chuck table 20 is bent slightly downwards to form an inclined plane 34 leading towards the receptacle 16.

Figure 5A:
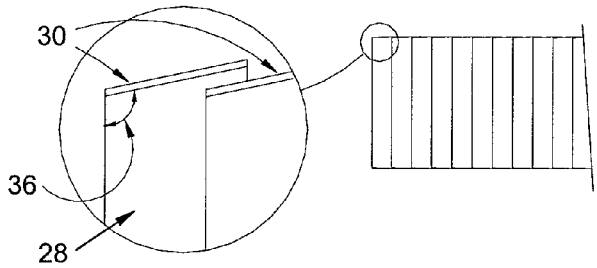
FIGS. 5A and 5B are top views of the bellows protecting cover of FIG. 3 when the bellows coupled to it is extended and retracted respectively.
Figure 5B:
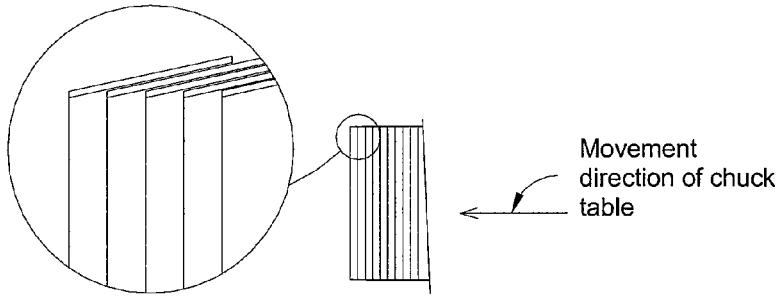

FIGS. 5A and 5B are top views of the bellows protecting cover 14 of FIG. 3 when the bellows 12 coupled to it is extended and retracted respectively. FIG. 5A is an enlarged top view of the bellows protecting cover 14 showing the angle of inclination of a vertical side of a panel 28 with respect to the horizontal edge of the panel 28 when the bellows protecting cover 14 is extended. In order to make all the panels 28 to be about the same shape and dimension, the vertical sides 30 of the panels 28 are folded at an angle 36 with respect to the edges when viewed from the top. This angle should preferably be larger than 90 degrees and smaller than 100 degrees depending on the travel distance of the chuck table 20. If the angle is 90 degrees, it is difficult to keep the length of the panels 28 the same. If the angle is larger than 100 degrees, the path of the debris to the receptacle 16 is likely to be blocked.

FIG. 5B is an enlarged top view showing the panels 28 when the bellows protecting cover 14 is retracted as the chuck table 22 moves longitudinally lengthwise along the cover 14 towards the receptacle 16. The gaps between neighbouring panels 28 overlap and are closed almost completely as compared to when the bellows protecting cover 14 is extended as in FIG. 5A. This prevents debris from seeping in between overlapping panels 28 on the horizontal surfaces of the cover 14.

Figure 6:
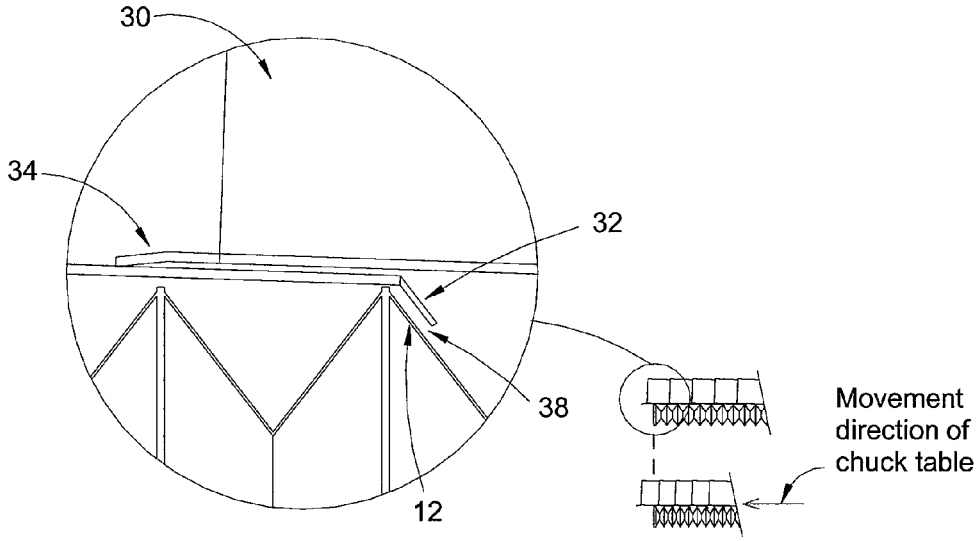
FIG. 6 is an enlarged side view of the bellows protecting cover coupled to the bellows as seen from direction "B" of FIG. 3.

FIG. 6 is an enlarged side view of the bellows protecting cover 14 coupled to the bellows 12 as seen from direction "B" of FIG. 3. The folded side 32 of the panel 28 forms a narrow gap 38 with a folded face of the bellows 12. This gap 38 is preferably filled with an adhesive for affixing the bellows protecting cover 14 to the bellows 12. The inclined plane 34 of the panel 28 rests on an adjoining panel 28. The inclined plane 34 closes the gap between the panels 28 so as to prevent debris from seeping through the gaps between the panels 28.

Figure 7:
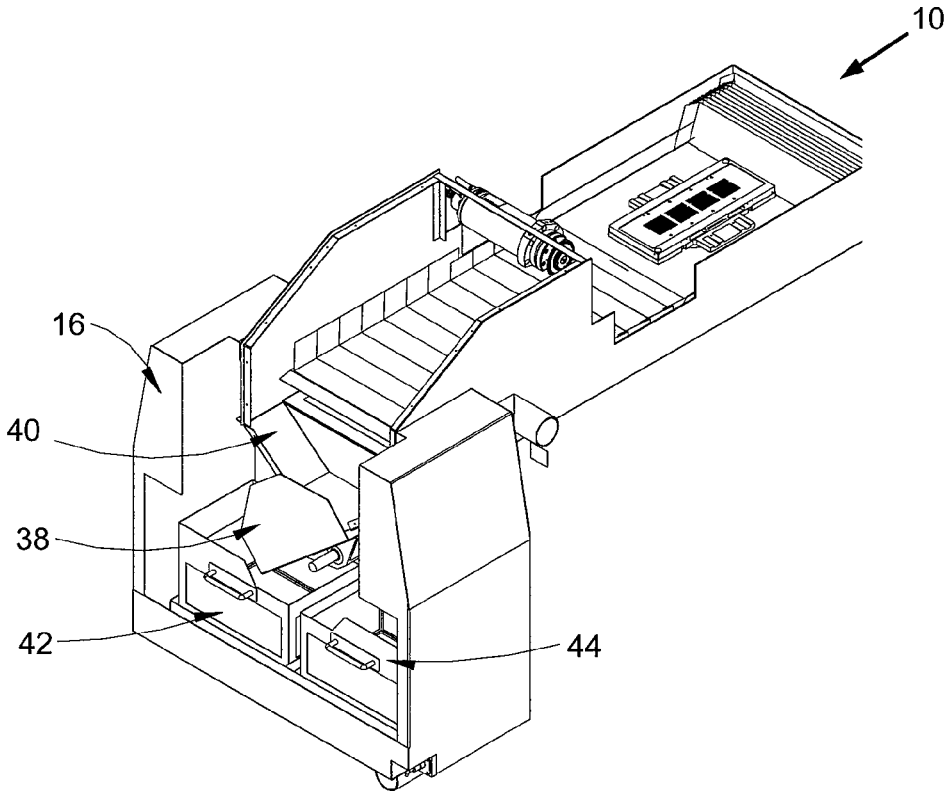
FIG. 7 is an isometric view of the drainage apparatus of FIG. 1 showing two scrap collectors within a receptacle of the drainage apparatus for collecting debris from the dicing process.

FIG. 7 is an isometric view of the drainage apparatus 11 of FIG. 1 showing two containers in the form of scrap collectors 42, 44 within a receptacle 16 of the drainage apparatus 11 for collecting debris from the dicing process. The receptacle 16 has two scrap collectors 42, 44 to collect debris created from singulating the workpiece. Each scrap collector 42, 44 comprise filters 17 to sieve off solid debris while the used machining water from the singulation process is channeled into a drain hole 26. In this way, it is not necessary to store used water in the drainage apparatus 11. A funnel 40 channels water, chips, scrap and debris that are on the bellows protecting cover 14 towards a rotary channel 38 made of sheet metal. The two scrap collectors 42, 44 are placed side by side under this rotary channel 38. In this figure, the rotary channel 38 can be seen to direct debris from the funnel 40 to one of the scrap collectors 42, 44.

Figure 8:
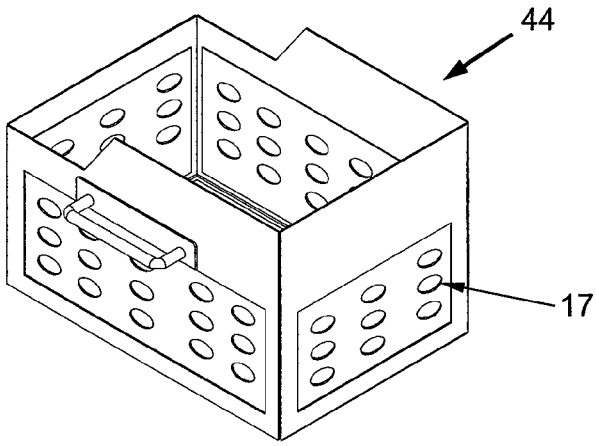
FIG. 8 is an isometric view of the scrap collector of FIG. 7.

FIG. 8 is an isometric view of the scrap collector 42, 44 of FIG. 7. This view shows the open scrap collector 44 with small holes on the side walls of the scrap collector 42, 44 as well as its bottom surface. Each scrap collector 42, 44 serves as a filter allowing used machining water to flow through them while keeping debris inside the collector.

Figure 9:
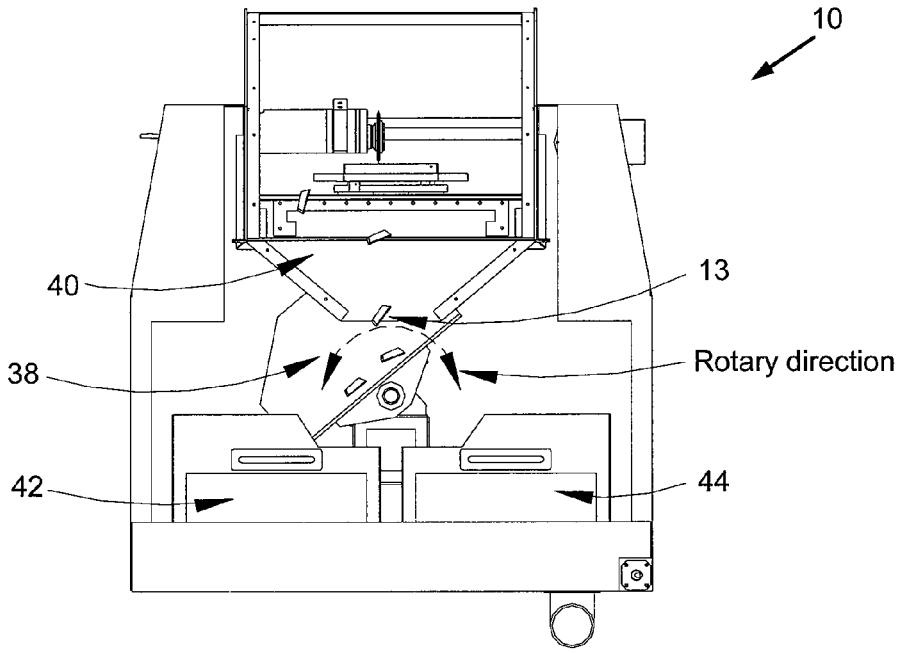
FIG. 9 is a back view of the singulation system of FIG. 1, illustrating the collection of debris into a first scrap collector.

FIG. 9 is a back view of the singulation system 10 of FIG. 1, illustrating the collection of debris into a first scrap collector 42. Water carrying debris 13 and scrap flow off the bellows protecting cover 14 into the funnel 40. The rotary channel 38, which is at a first position, then diverts all the used machining water, chips, scrap and debris 13 into the first scrap collector 42.

Figure 10:
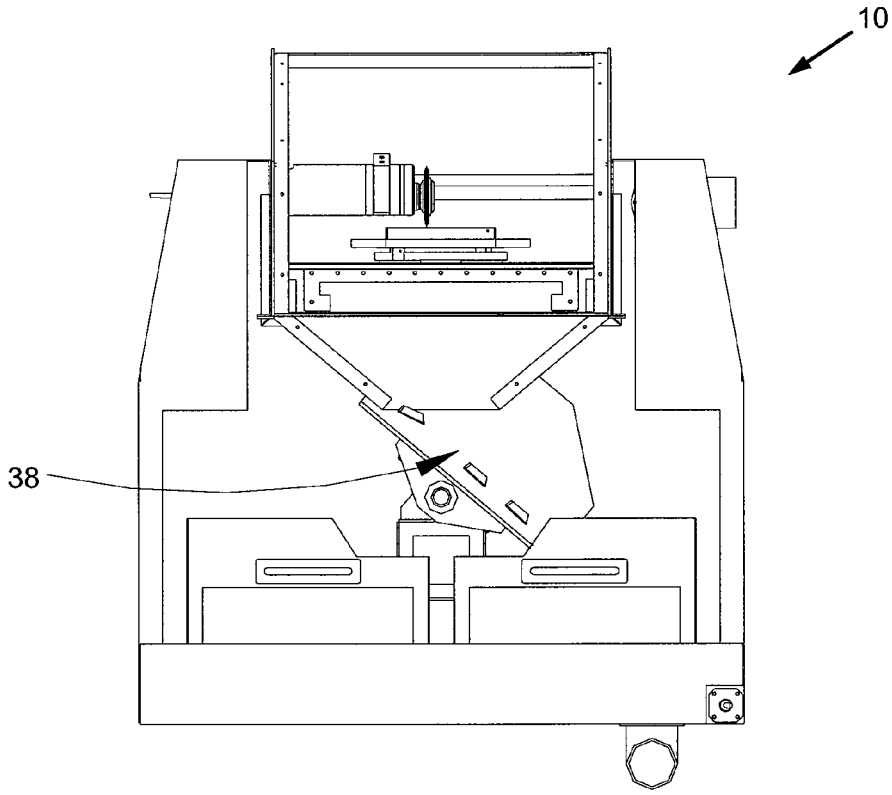
FIG. 10 is a back view of the singulation system of FIG. 1, illustrating the collection of debris into a second scrap collector.

FIG. 10 is a back view of the singulation system 10 of FIG. 1, illustrating the collection of debris into a second scrap collector 44. When the first scrap collector 42 is full, the rotary channel 38 is rotated in a clockwise direction to a second position so that debris 13 from the bellows protecting cover 14 can be diverted to the second scrap collector 44. In this way, the singulation system does not need to be left idle when the scrap collector 42, 44 is full and is removed for emptying the contents. A sensor detects whether the scrap collectors 42, 44 are full. If automation is necessary, a pneumatic cylinder (not shown) may be used to rotate the rotary channel 38.

It should be appreciated that the U-shaped bellows protecting cover 14 of the drainage apparatus 11, in accordance with the preferred embodiment of the invention, facilitates the flow of chips, scrap and debris 13 directly to the receptacle 16 without any debris 13 falling off the sides of the cover 14. This eliminates the need for a drainage channel at the sides of the bellows 12 although such drainage channel may still be installed as a backup measure in case of water leakage. It is also unnecessary to have a pressure means such as a water cleaning nozzle to force the debris 13 to the receptacle 16. Therefore, the overall drainage apparatus 11 is of a simpler construction with fewer components. Scrap and debris 13 will also not tend to accumulate in the drainage apparatus 11. This makes it easier to remove the scraps and other debris. Moreover, as there is more than one scrap collector, and more preferably two scrap collectors 42, 44, removing debris 13 from a collector that is full does not require stopping the whole singulation system 10. Hence, idling time of the singulation system 10 is reduced and efficiency is improved.

The invention described herein is susceptible to variations, modifications and/or additions other than those specifically described and it is to be understood that the invention includes all such variations, modifications and/or additions which fall within the spirit and scope of the above description.

The invention claimed is:

1. Singulation system for a workpiece, comprising:

a carrier for mounting the workpiece during singulation;

a receptacle operative to collect debris formed during singulation;

a driving mechanism for moving the carrier and workpiece;

a bellows that at least partially covers the driving mechanism; and a bellows protecting cover extending over the bellows which is coupled between the carrier and the receptacle and which is operative to guide debris from the carrier along a longitudinal length of the bellows protecting cover towards the receptacle;

wherein the bellows protecting cover comprises side walls extending along opposite sides of the longitudinal length of the bellows protecting cover which prevent debris from falling off the side walls of the bellows protecting cover.

2. Singulation system as claimed in claim 1, wherein the driving mechanism is operative to drive the carrier along a linear axis, and the side walls of the bellows protecting cover are substantially parallel to said linear axis.

3. Singulation system as claimed in claim 1, wherein the bellows protecting cover is coupled to the bellows such that the bellows protecting cover retracts and extends correspondingly with the bellows in directions of movement of the carrier.

4. Singulation system as claimed in claim 3, wherein the carrier abuts the bellows protecting cover and is drivable to contract the bellows protecting cover so as to push the debris into a receptacle.

5. Singulation system as claimed in claim 1, wherein the side walls are substantially vertical.

6. Singulation system as claimed in claim 1, wherein the bellows protecting cover comprises a plurality of individual U-shaped panels.

7. Singulation system as claimed in claim 6, wherein the plurality of individual U-shaped panels are arranged lengthwise next to one another and overlap one another.

8. Singulation system as claimed in claim 7, wherein the panels are each substantially equivalent dimensions.

9. Singulation system as claimed in claim 6, wherein each of the panels has opposite ends that are folded, with respect to the panel between the ends, to form the U-shape.

10. Singulation system as claimed in claim 9, wherein an angle between an edge of a folded end of each panel and an edge of an unfolded part of each panel is larger than 90 degrees and less than 100 degrees.

11. Singulation system as claimed in claim 6, wherein an end of each panel nearest to the carrier is folded and attached to a surface of the bellows.

12. Singulation system as claimed in claim 11, wherein an end of each panel opposite the said end nearest to the carrier is further bent to form an inclined plane leading towards the receptacle.

13. Singulation system as claimed in claim 12, wherein the inclined plane of each panel rests on an adjoining panel to close gaps between the two adjoining panels and to prevent seepage of debris between the two adjoining panels.

14. Singulation system as claimed in claim 1, wherein the receptacle comprises more than one container for collecting debris.

15. Singulation system as claimed in claim 14, wherein each container further comprises a filter to sieve off solid debris.

16. Singulation system as claimed in claim 15, wherein each filter comprises small holes on side walls and a bottom surface of each respective container.

17. Singulation system as claimed in claim 14, further comprising a funnel located between the bellows protecting cover and the containers for channeling debris to the containers.

18. Singulation system as claimed in claim 17, further comprising a rotary channel which is in communication with the funnel and which is operative to move between first and second positions to selectively drain debris to one or another of the containers.

19. Drainage apparatus for a singulation system for a workpiece mounted on a carrier during singulation, the singulation system further comprising a driving mechanism for moving the carrier and workpiece and a bellows that at least partially covers the driving mechanism, the drainage apparatus comprising:

a receptacle operative to collect debris formed during singulation; and a bellows protecting cover extending over the bellows which is coupled between the carrier and the receptacle and which is operative to guide debris from the carrier along a longitudinal length of the bellows protecting cover towards the receptacle;

wherein the bellows protecting cover compasses side walls extending along opposite sides of the longitudinal length of the bellows protecting cover which prevents debris from falling off the side walls of the bellows protecting cover.

* * * * *